US007698970B1

(12) United States Patent
Chavez et al.

(10) Patent No.: US 7,698,970 B1
(45) Date of Patent: Apr. 20, 2010

(54) CARABINER MULTI-TOOL

(76) Inventors: Jason Chavez, 610 E. Gilbert Dr., #138, Tempe, AZ (US) 85281; Joseph Velasquez, 3370 N. Haydn Rd., #123, Scottsdale, AZ (US) 85251

( * ) Notice: Subject to any disclaimer, the term of this patent is extended or adjusted under 35 U.S.C. 154(b) by 81 days.

(21) Appl. No.: 12/099,341

(22) Filed: Apr. 8, 2008

Related U.S. Application Data

(60) Provisional application No. 60/910,762, filed on Apr. 9, 2007.

(51) Int. Cl.
*B25B 13/00* (2006.01)

(52) U.S. Cl. ..... 81/124.4; 7/138; D8/26

(58) Field of Classification Search ..... 81/124.4; 7/138; D8/26, 28; 24/598.3, 598.7, 599.3, 24/600.2
See application file for complete search history.

(56) References Cited

U.S. PATENT DOCUMENTS 391,211 A * 10/1888 Torkelson ..... 7/138
D120,489 S * 5/1940 Musselman ..... D8/17
D142,263 S * 8/1945 Pierre ..... D8/26
D356,240 S * 3/1995 Meldahl ..... D8/105
6,223,372 B1 * 5/2001 Barber ..... 7/118
D473,436 S * 4/2003 Pilatzke et al. ..... D8/28
2005/0144730 A1 * 7/2005 Barber et al. ..... 7/138
2005/0217436 A1 * 10/2005 Wolf ..... 81/124.4

* cited by examiner

*Primary Examiner*—D. S Meislin
(74) *Attorney, Agent, or Firm*—Parsons & Goltry; Robert A. Parsons; Michael W. Goltry

(57) ABSTRACT

A carabiner multi-tool includes a first generally C-shaped portion, a central extended portion, and a second generally C-shaped portion with the central extended portion joining the first and second C-shaped portions into a continuous body. Second ends of the first and the second C-shaped portions form first and second body ends positioned in spaced apart substantially opposed relationship. A shaft has one end pivotally attached to the first body end and a free end pivotally movable into a closed orientation with the second body end and an open orientation with the second body end. An engagement member is mounted on either the free end of the shaft or the second body end for engaging the free end of the shaft and the second body end in a closed orientation. Multiple tools are formed in the first and the second generally C-shaped portions.

17 Claims, 13 Drawing Sheets

CARABINER MULTI-TOOL

CROSS-REFERENCE TO RELATED APPLICATIONS

This application claims the benefit of U.S. Provisional Application No. 60/910,762, filed 9 Apr. 2007.

FIELD OF THE INVENTION

This invention generally relates to tools for use in care and maintenance in sports equipment and work requiring the handy storage of various tools.

BACKGROUND OF THE INVENTION

In many fields, especially many modern sports, such as skateboarding and the like, the equipment serves best if care and maintenance are practiced regularly. While skateboards and the like are used herein for a convenient example, it will be understood that the tools referred to might be used with virtually any activity where such tools are kept handy for quick and multiple use. Skateboarding is referred to specifically as an example of equipment which, because of the complexity of much of the equipment adjustments, tightening, and other factors may need constant attention. To perform this care and maintenance in many instances requires special tools that can be cumbersome and inconvenient to carry along during performance or use of the equipment.

It would be highly advantageous, therefore, to remedy the foregoing and other deficiencies inherent in the prior art.

Accordingly, it is an object of the present invention to provide a new and improved carabiner multi-tool.

It is another object of the present invention to provide a new and improved carabiner multi-tool including a carabiner-type arrangement for easy and convenient carrying.

Another object of the invention is to provide a new and improved carabiner multi-tool including multiple tools and multiple types of tools in a single carabiner-type unit.

SUMMARY OF THE INVENTION

Briefly, to achieve the desired objects of the instant invention in accordance with a preferred embodiment thereof, carabiner multi-tool includes a first generally C-shaped portion, a central extended portion, and a second generally C-shaped portion with the central extended portion joining the first and second C-shaped portions into a continuous body. Second ends of the first and the second C-shaped portions form first and second body ends positioned in spaced apart substantially opposed relationship. A shaft has one end pivotally attached to the first body end and a free end pivotally movable into a closed orientation with the second body end and an open orientation with the second body end. An engagement member is mounted on either the free end of the shaft or the second body end for engaging the free end of the shaft and the second body end in a closed orientation. Multiple tools are formed in the first and the second generally C-shaped portions.

The desired objects of the instant invention are further realized in accordance with a specific embodiment in which a carabiner multi-tool includes a first generally C-shaped portion defining a first socket wrench opening therein, a second generally C-shaped portion defining a second socket wrench opening therein, and a central extended portion joining a first end of the first C-shaped portion and a first end of the second C-shaped portion into a continuous body with a second end of the first C-shaped portion and a second end of the second C-shaped portion forming a first body end and a second body end positioned in spaced apart substantially opposed relationship. An elongated shaft has a fixed end pivotally attached to the first body end and a free end with the free end being pivotally movable into a closed orientation and an open orientation. An engagement member including an axially extending socket wrench opening is mounted on the free end of the elongated shaft for limited axial movement therealong. The axially extending socket wrench opening is mounted on the free end of the shaft for engaging the second body end in the closed orientation and locking the shaft in the closed orientation.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
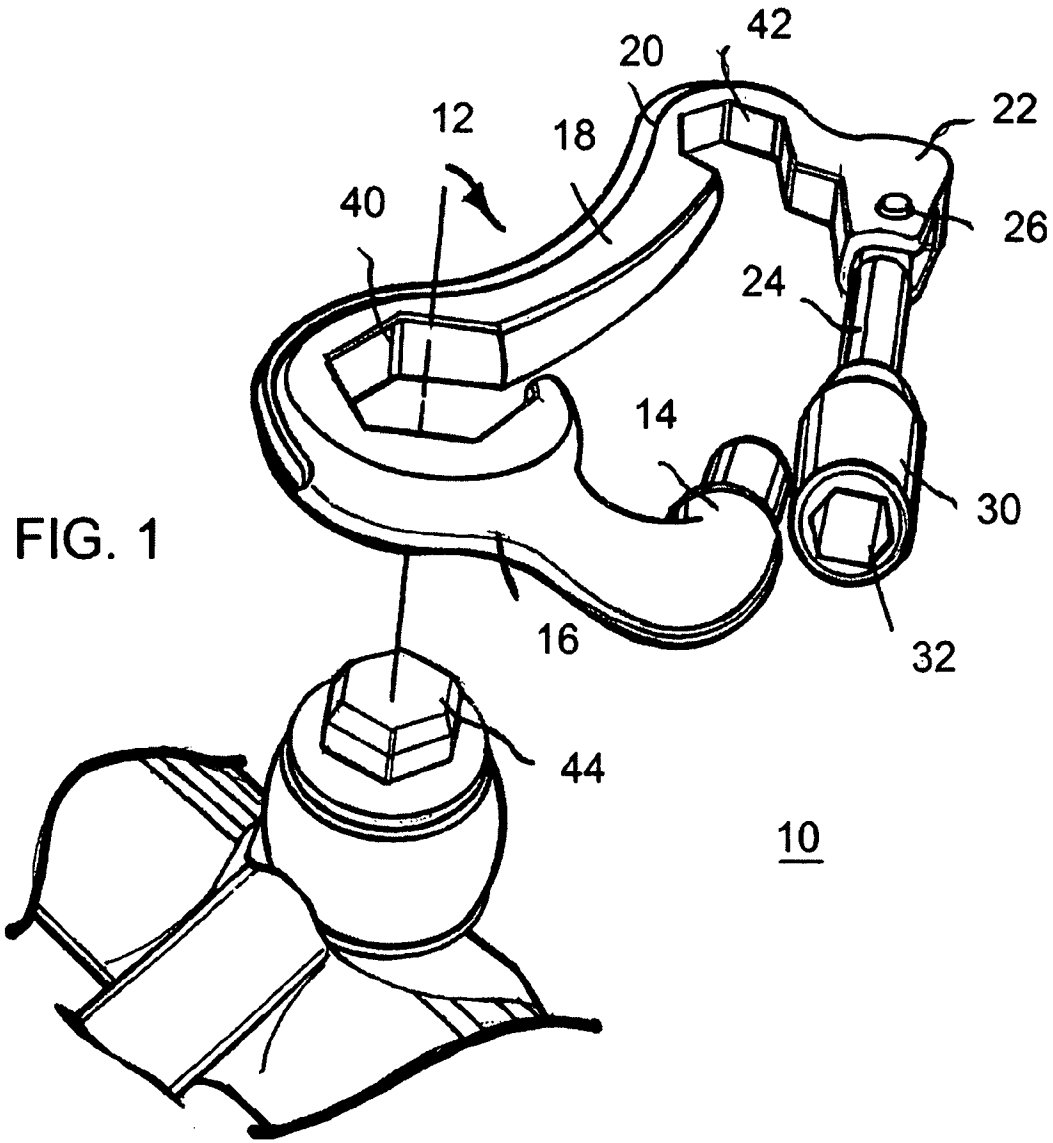
FIG. 1 is a view in perspective of a carabiner multi-tool, in an open orientation, in accordance with the present invention.

Turning now to the drawings, attention is first directed to FIGS. 1-4 which illustrate a carabiner multi-tool 10 including an irregularly shaped body 12. While carabiner multi-tool 10 is described herein as a tool for use with various sports equipment (e.g. skateboards, etc.) it will be understood that the tool might be used with virtually any activity where such a tool is kept handy for quick and multiple use. Body 12 is formed generally in the shape of a carabiner, i.e. the well known climber's clamp or ring. Body 12 is formed as a single integral unit including a first end 14, a C-shaped portion 16, a central extended portion 18 and a second C-shaped portion 20 that terminates in a second end 22. The various portions 16, 18, and 20 are formed so that ends 14 and 22 are positioned in a spaced apart, opposed relationship.

To complete the carabiner-type ring or clamp, a shaft 24 is pivotally attached to end 22 by means of a pivot pin 26. Shaft 24 is attached for pivotal movements into and out of alignment with end 14. Carabiner multi-tool 10 is in the closed orientation when shaft 24 is pivoted into alignment with end 14 (see FIG. 3). Carabiner multi-tool 10 is in the open orientation when shaft 24 is pivoted out of alignment with end 14 (see FIG. 1).

Figure 5:
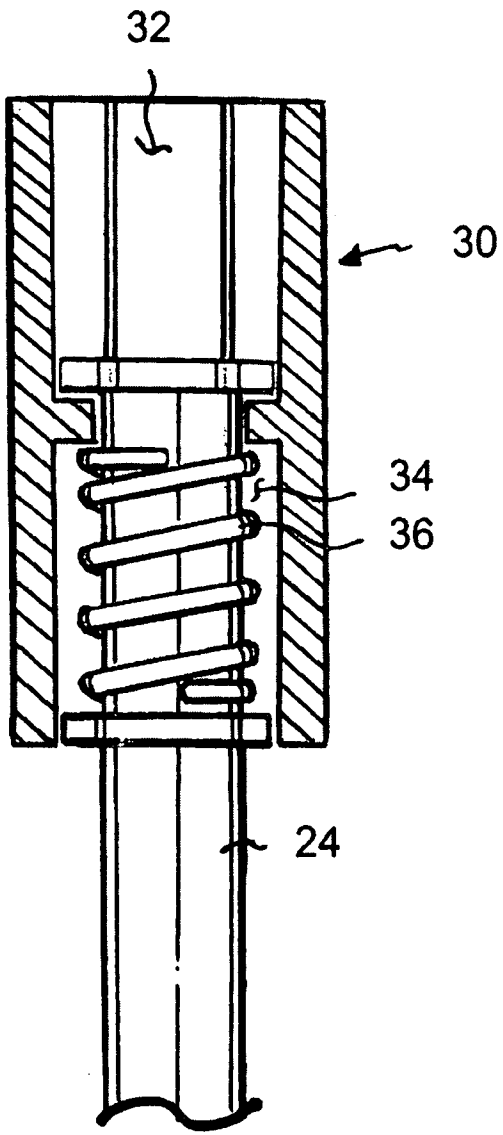
FIG. 5 is a sectional view of a portion of the carabiner multi-tool of FIG. 3.

An engagement member is attached to the free end of shaft 24 for engaging end 14 and locking shaft 24 in the closed orientation. While the engagement member can have a variety of different embodiments, such as the entire shaft being axially or longitudinally movable, the free end of shaft 24 being axially or longitudinally movable and end 14 of body 12 being movable, in this preferred embodiment the engagement member includes a socket wrench 30 mounted on the free end of shaft 24 for limited axial movement therealong. In this embodiment, socket wrench 30 includes an axially extending socket opening 32 and a guiding opening 34 formed to enclose and trap the free end of shaft 24. Guiding opening 34 is formed to surround and hold the free end of shaft 24 therein while allowing limited axial movement in a piston-like fashion of the free end of shaft 24 within guiding opening 34. A compression spring 36 is positioned in guiding opening 34 between the free end of shaft 24 and an inner wall of guiding opening 34. Compression spring 36 biases socket 30 into an axially extended orientation as shown in FIG. 5.

Figure 3:
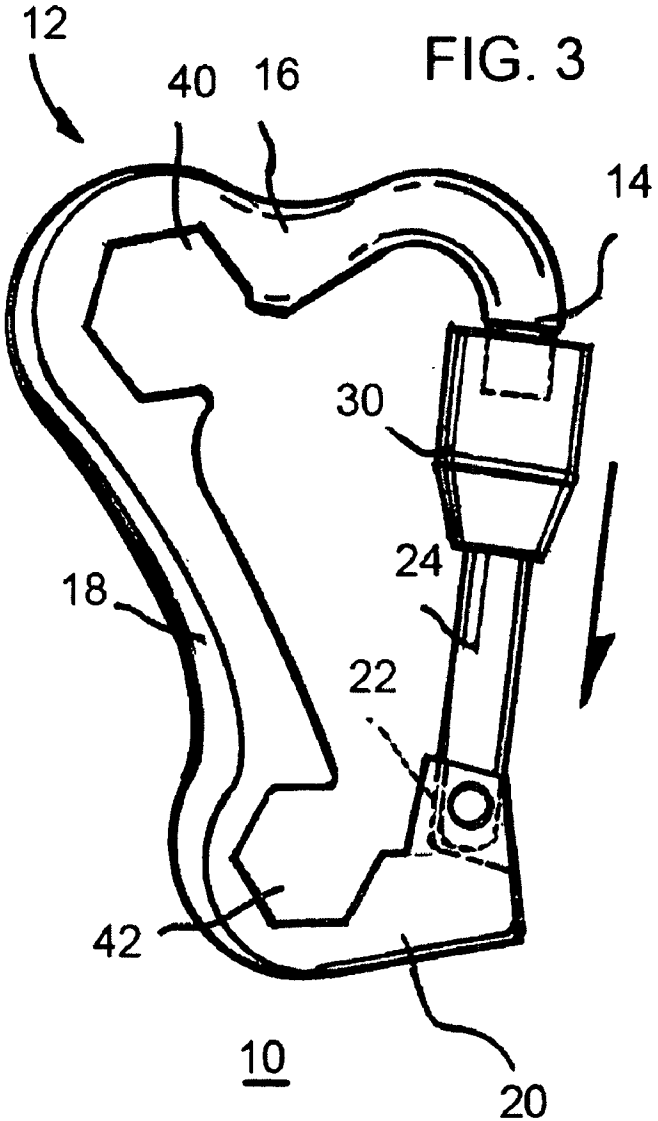
FIG. 3 is a side plan view of the carabiner multi-tool of FIG. 1 in the closed orientation.
Figure 4:
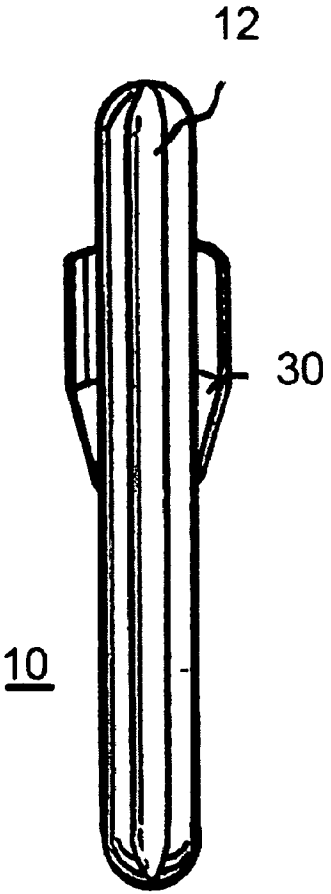
FIG. 4 is a back view of the carabiner multi-tool of FIG. 1.

Referring specifically to FIG. 1, with socket 30 biased into the axially extended orientation shown, socket opening 32 is available for use as a socket wrench. Shaft 24 can be pivoted outwardly farther than shown in FIG. 1, as much as ninety degrees or more, if desired or necessary for use. To complete the carabiner-type ring or clamp, socket 30 is pressed axially along shaft 24 as shaft 24 is pivoted into alignment with end 14 of body 12. Once axial alignment is achieved, socket 30 is released and spring 36 biases socket 30 into engagement with end 14 so that carbines multi-tool 10 is essentially locked in the closed orientation as shown in FIG. 3.

Thus, carabiner multi-tool 10 can be conveniently carried by simply snapping it onto a belt or other piece of clothing in the same fashion as climbers carry carabiners. When positioned to encircle a belt or the like and locked in the closed orientation as shown in FIG. 3, carabiner multi-tool 10 cannot be lost or dropped and is convenient for use at any time. Also, it can be snapped onto a belt or other piece of clothing in a position that is out of the way so as not to interfere with whatever sport or other activity in which the user is engaged.

Figure 7:
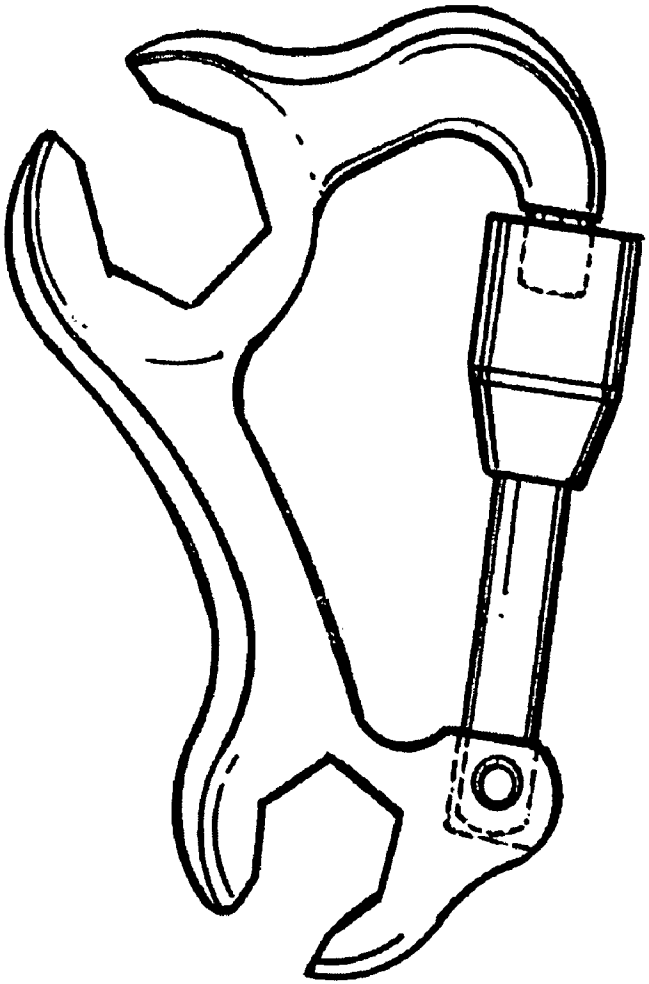
FIG. 7 is a side plan view of another embodiment of a carabiner multi-tool illustrating outwardly opening hexagonal wrenches.
Figure 6:
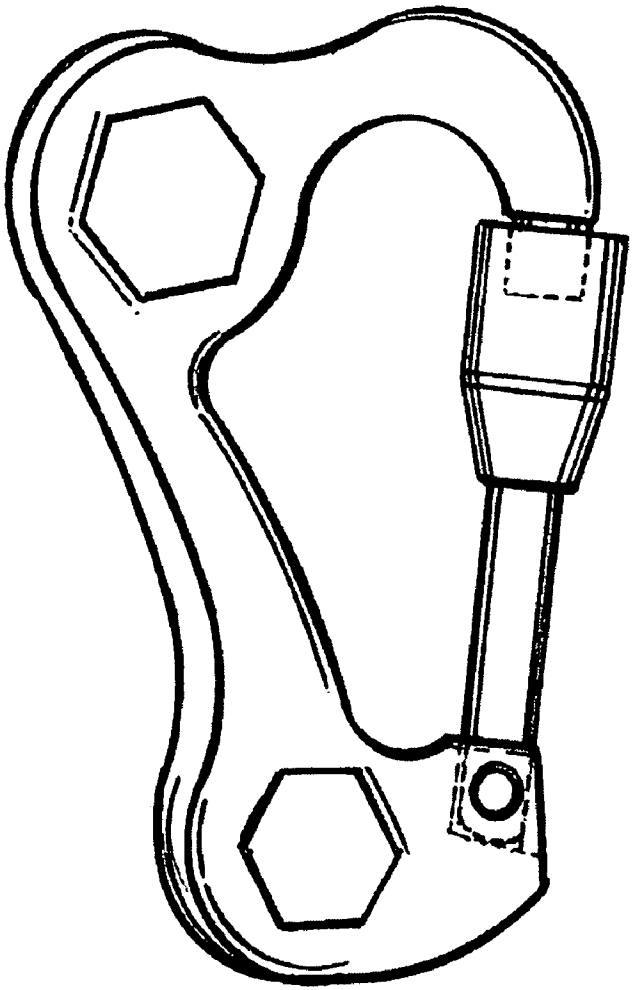
FIG. 6 is a side plan view of another embodiment of a carabiner multi-tool illustrating closed hexagonal wrenches.
Figure 8:
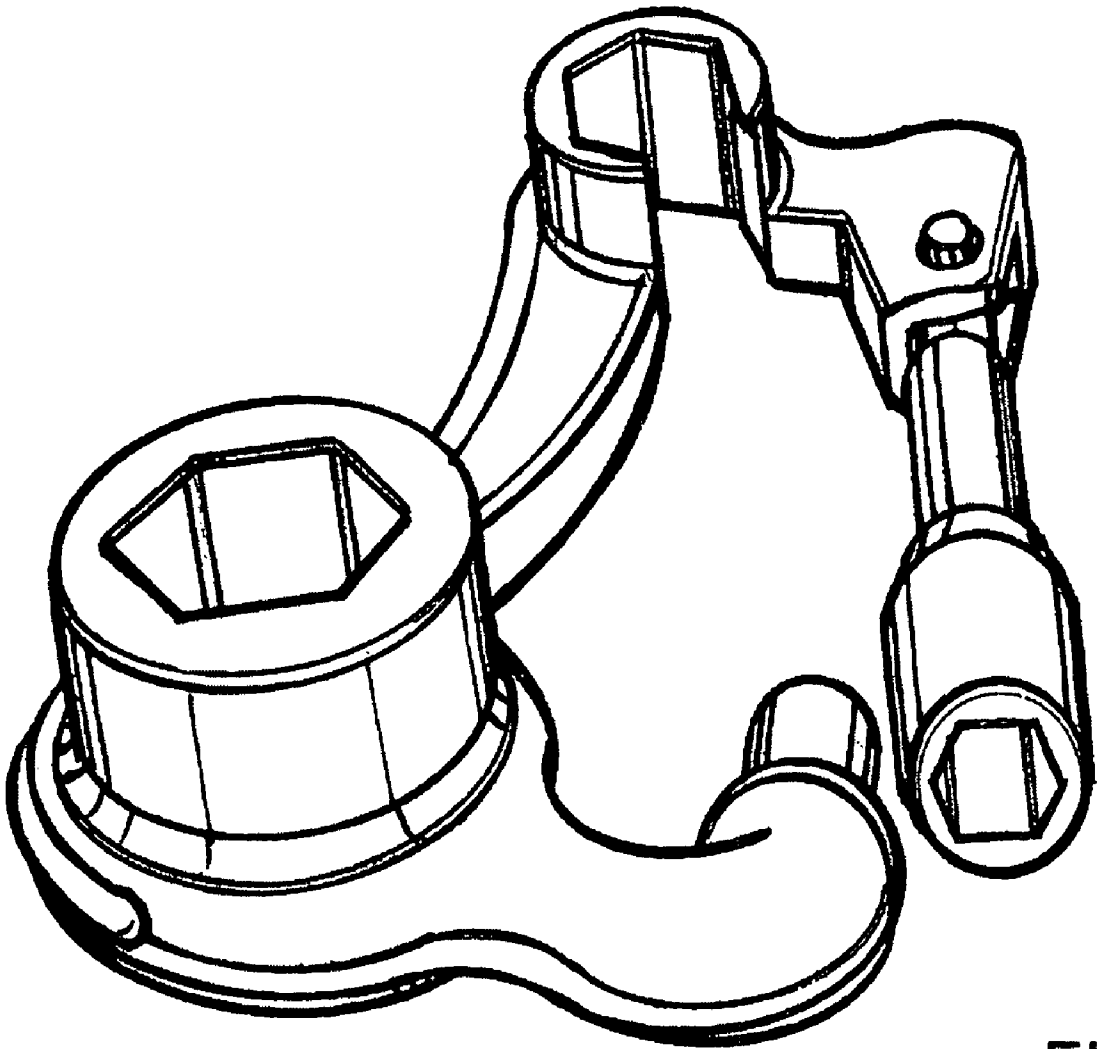
FIG. 8 is a perspective view of another embodiment of a carabiner multi-tool illustrating extended hexagonal wrenches.

Another socket wrench 40 is formed in C-shaped portion 16 of body 12. Another socket wrench 42 is formed in C-shaped portion 20 of body 12. In this embodiment, socket wrenches 40 and 42 open inwardly (into the interior opening of carabiner multi-tool 10) to allow carabiner multi-tool 10 to be slipped over an axle or the like as socket wrench 40 is engaged over a nut axially positioned in alignment with the axle. In FIG. 1, a typical use is illustrated, showing socket wrench 40 in a position to tighten or loosen a nut 44 on an exterior assembly, such as a skateboard or the like. In a similar embodiment illustrated in FIG. 6, socket wrenches formed in the two C-shaped portions of the body are formed so as to be completely enclosed. In a similar embodiment illustrated in FIG. 7, socket wrenches formed in the two C-shaped portions of the body are formed so as to open outwardly (away from the interior opening of the carabiner multi-tool). In still another embodiment, illustrated in FIG. 8, the socket wrenches are formed with axially extending sides to provide a better grip for the wrench. Also in the embodiment of FIG. 8 one of the wrenches is completely enclosed and the other wrench opens inwardly to further illustrate the potential versatility of design. Thus, it can be seen that virtually any size and shape of wrenches can be formed in the body of the carabiner multi-tool.

Figure 9:
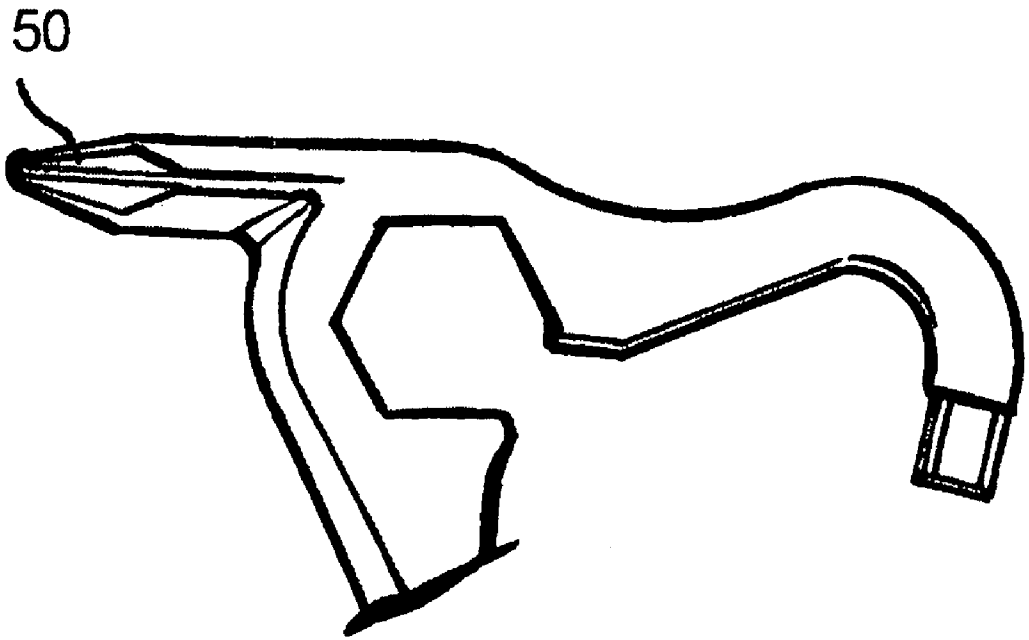
FIG. 9 is a side plan view of a portion of another embodiment of a carabiner multi-tool illustrating the incorporation of another tool.

Turning now to FIG. 9, another potential embodiment is illustrated. In this embodiment a screw driver 50 is formed in the outer body (generally at a corner) so as to extend beyond the body and thus be available for use. As will be understood the screw driver can be formed with any of the ends or heads presently used (e.g., Philips head, blade head, etc.), depending upon the desired use of the carbines multi-tool.

Figure 10:
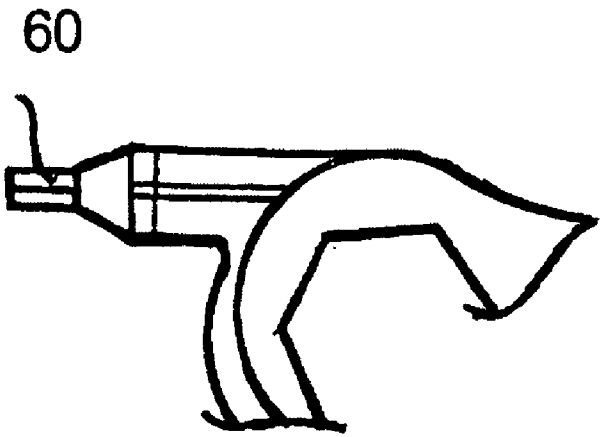
FIG. 10 is a side plan view of a portion of another embodiment of a carabiner multi-tool illustrating the incorporation of another tool.

Turning now to FIG. 10, another potential embodiment is illustrated. In this embodiment a wrench end 60 is formed in the outer body (generally at a corner) so as to extend beyond the body and thus be available for use. As will be understood, wrench end 60 can be formed with any of the ends (e.g., hex-wrench, angle wrench, etc.) depending upon the desired use of the carabiner multi-tool.

Figure 2:
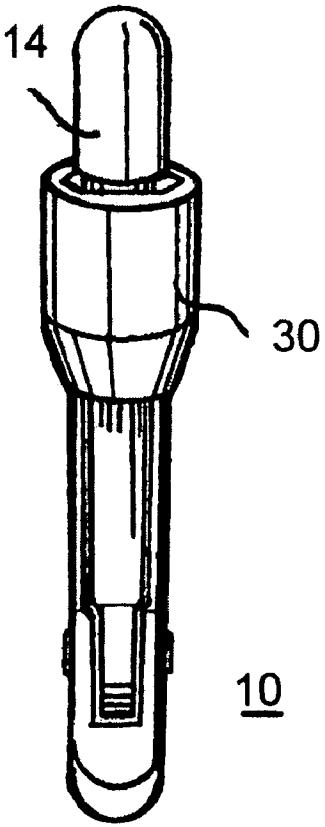
FIG. 2 is a front view of the carabiner multi-tool of FIG. 1 in a closed orientation.

Turning now to FIGS. 11 through 17 several different views of another embodiment of a carabiner multi-tool, designated 10', in accordance with the present invention are illustrated. In this embodiment components similar to components described in conjunction with the embodiment illustrated in FIG. 1 are designated with similar numbers and a prime (') is added to indicate the different embodiment. Referring specifically to FIGS. 1-3, carabiner multi-tool 10' includes an irregularly shaped body 12'. Body 12' is formed generally in the shape of a carabiner, i.e. the well known climber's clamp or ring. In this embodiment, body 12' is formed as a single integral unit but may be formed in multiple components joined into a single unit as shown. Body 12' includes a first end 14', a C-shaped portion 16', a central extended portion 18' and a second C-shaped portion 20' that terminates in a second end 22'. The various portions 16', 18', and 20' are formed so that ends 14' and 22' are positioned in a spaced apart, opposed relationship.

Figure 14:
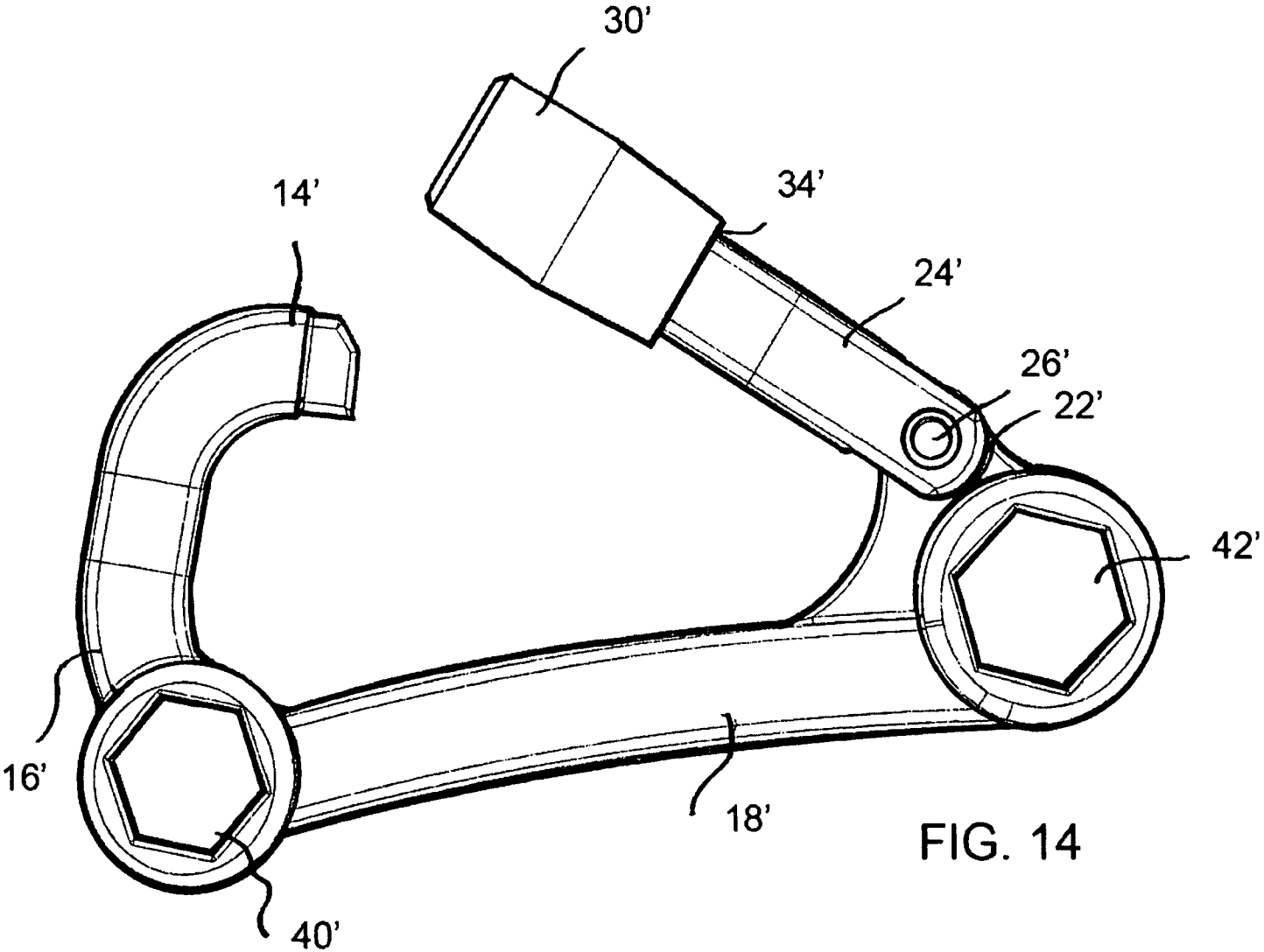

To complete the carabiner-type ring or clamp, a shaft 24' is pivotally attached to end 22' by means of a pivot pin 26'. Shaft 24' is attached for pivotal movements into and out of alignment with end 14'. As can be seen in FIGS. 14 and 16, shaft 24' can be pivoted outwardly away from the central opening of carabiner multi-tool 10' (FIG. 14) or inwardly into the central opening of carabiner multi-tool 10' (FIG. 16). Carabiner multi-tool 10' is in the closed orientation when shaft 24' is pivoted into alignment with end 14' (see FIGS. 11-14). Carabiner multi-tool 10' is in the open orientation when shaft 24' is pivoted out of alignment with end 14' (see FIGS. 14-17).

An engagement member is attached to the free end of shaft 24' for engaging end 14' and locking shaft 24' in the closed orientation. While the engagement member can have a variety of different embodiments, such as the entire shaft being axially or longitudinally movable, the free end of shaft 24' being axially or longitudinally movable and end 14' of body 12' being movable, in this preferred embodiment the engagement member includes a socket wrench 30' mounted on the free end of shaft 24' for limited axial movement therealong. In this embodiment, socket wrench 30' can include an axially extending socket opening and a guiding opening formed to enclose and trap the free end of shaft 24', as explained in conjunction with the above embodiment. Guiding opening 34' is formed to surround and hold the free end of shaft 24' therein while allowing limited axial movement in a piston-like fashion of the free end of shaft 24' within guiding opening 34'. A compression spring is positioned in guiding opening 34' between the free end of shaft 24' and an inner wall of guiding opening 34'. The compression spring biases socket 30' into an axially extended orientation as explained above.

Figure 11:
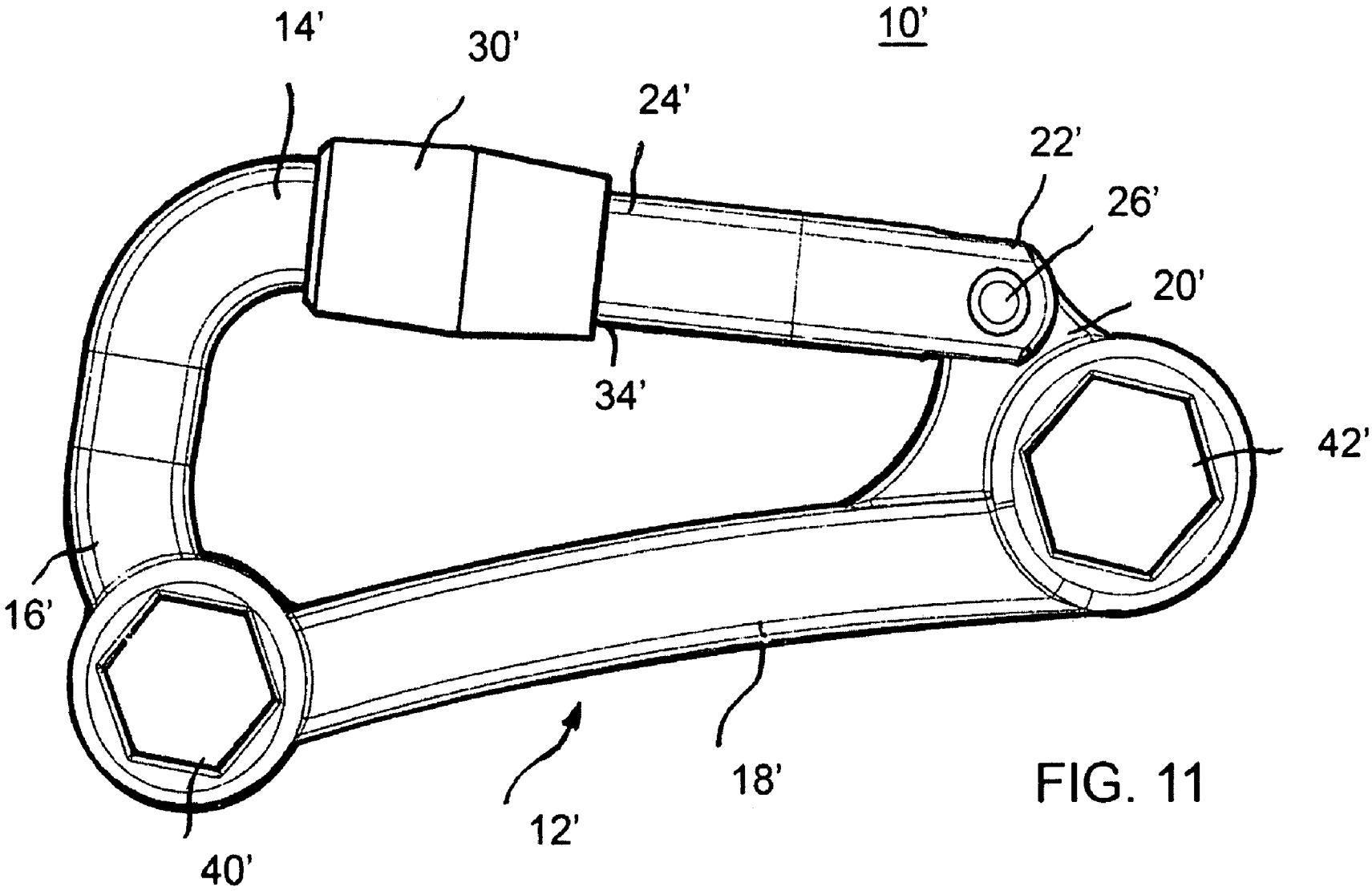
FIGS. 11 through 17 illustrate another embodiment of a carabiner multi-tool illustrating the incorporation of tools therein in accordance with the present invention.
Figure 12:
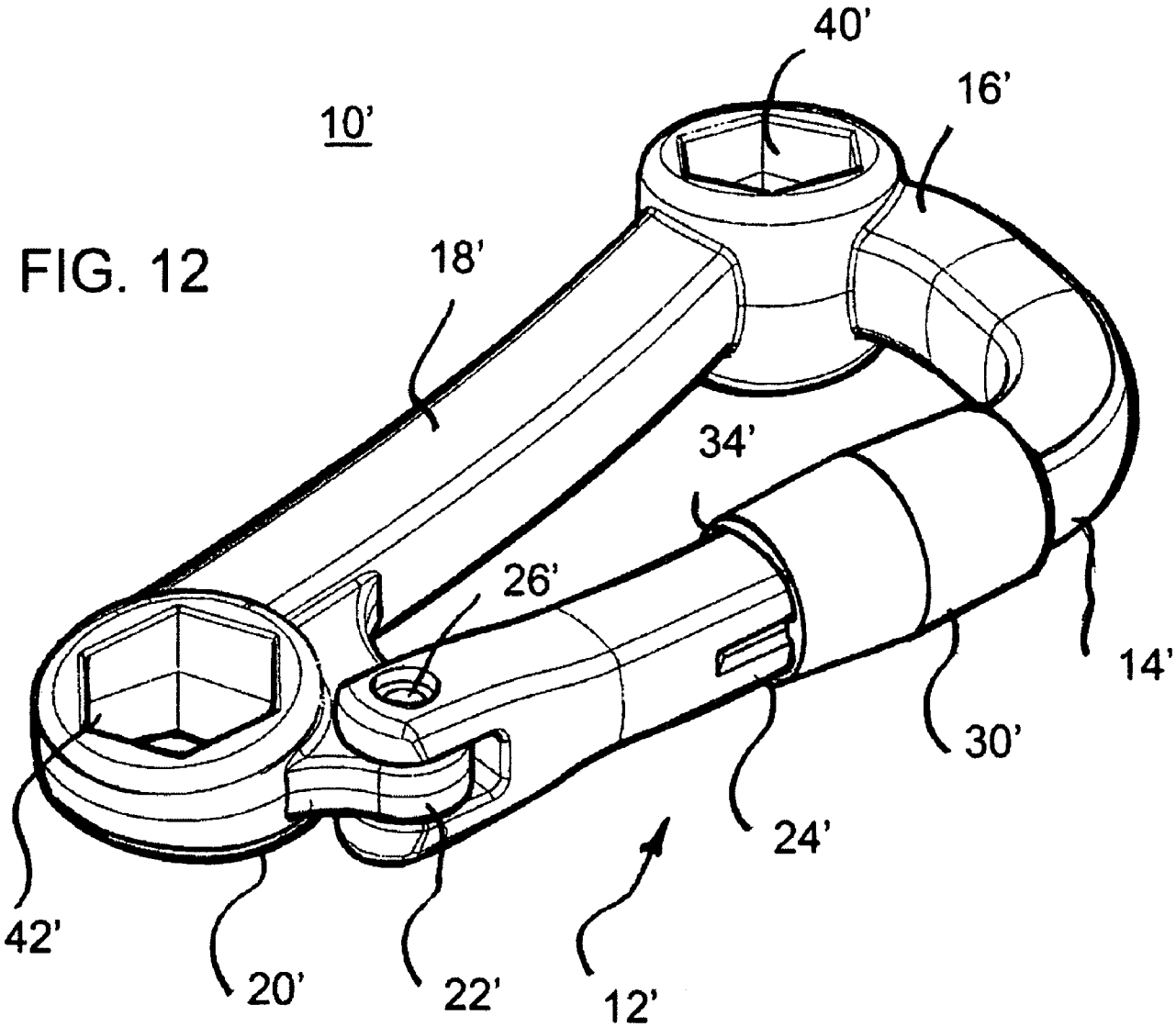
Figure 13:
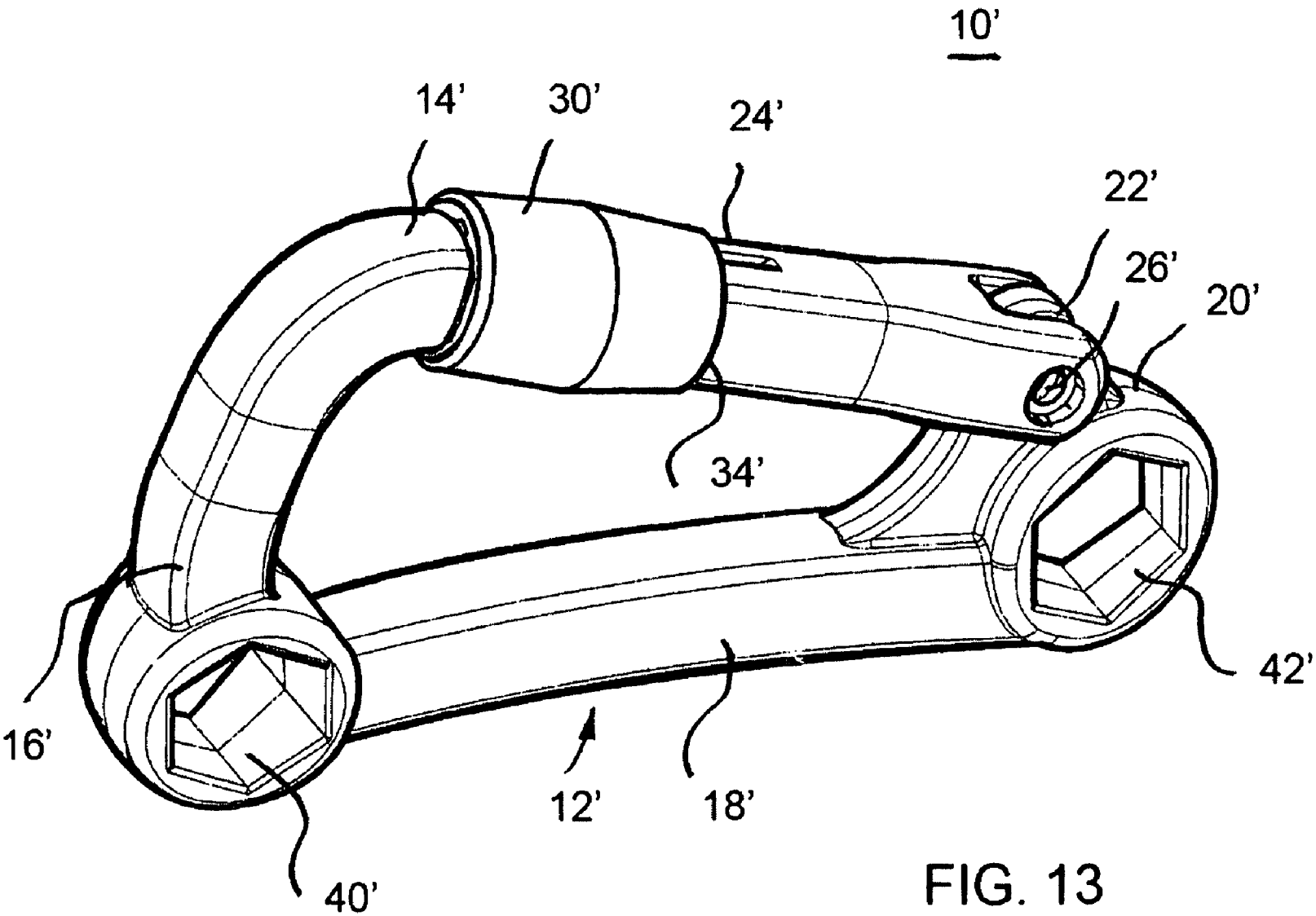
Figure 15:
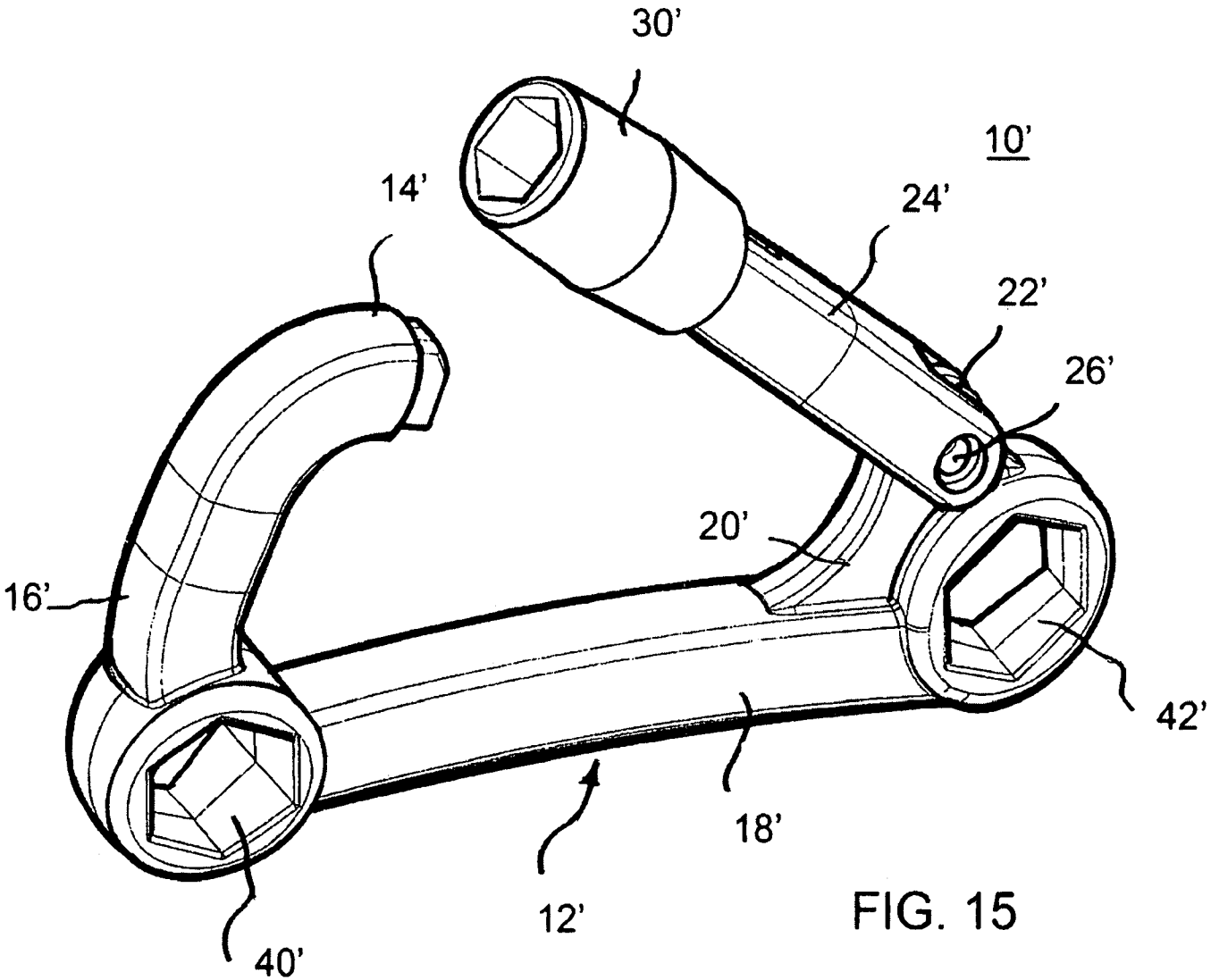
Figure 16:
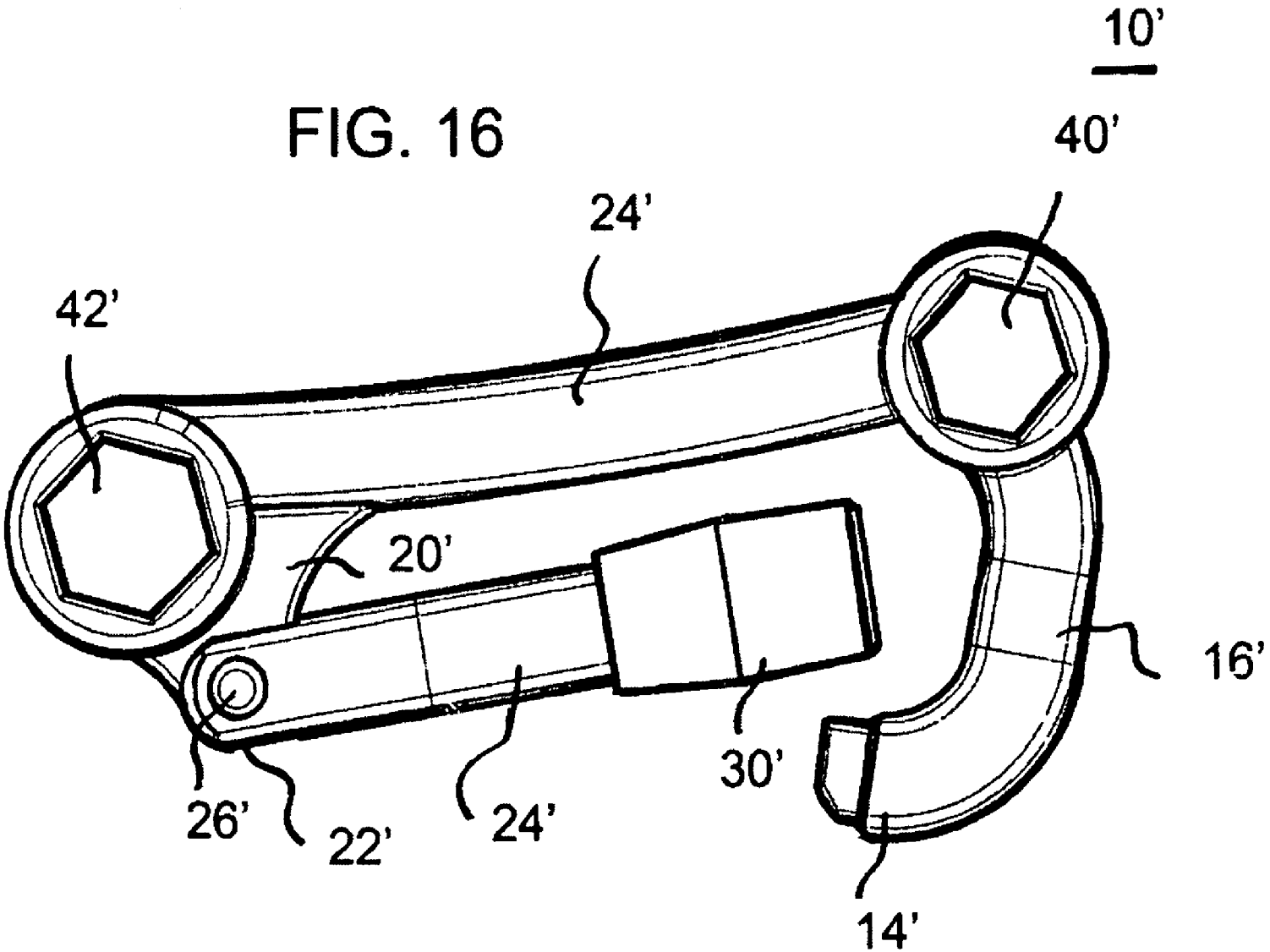
Figure 17:
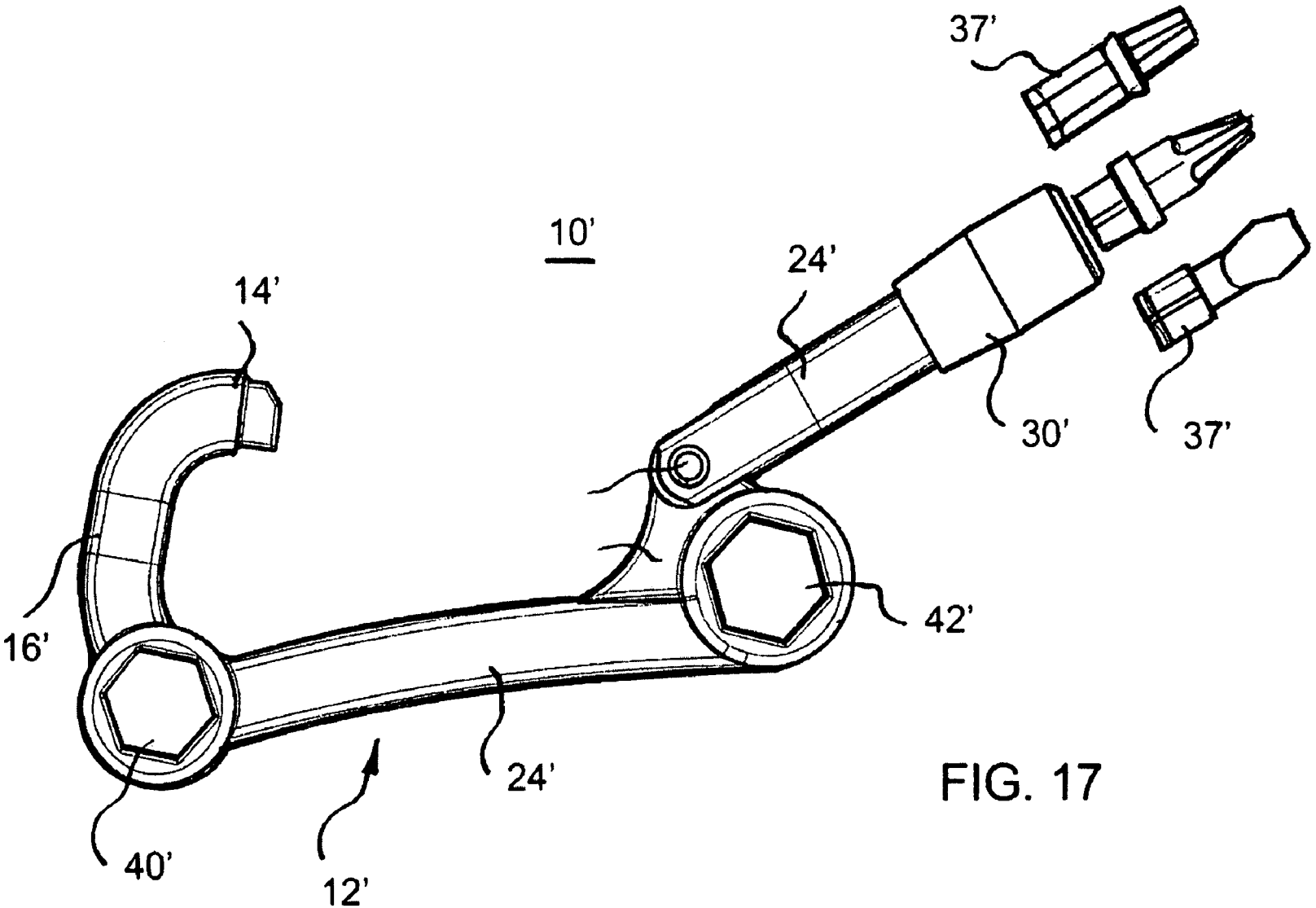

Referring specifically to FIGS. 14 and 15, with socket 30' biased into the axially extended orientation shown, socket opening 32' is available for use as a socket wrench. Shaft 24' can be pivoted outwardly farther than shown in FIG. 14, as much as ninety degrees or more as illustrated in FIG. 17, if desired or necessary for use. Further, in this orientation socket type screw drivers 37' may be inserted into socket 30' for use in other tasks. To complete the carabiner-type ring or clamp, socket 30' is pressed axially along shaft 24' as shaft 24' is pivoted into alignment with end 14' of body 12'. Once axial alignment is achieved, socket 30' is released and the spring biases socket 30' into engagement with end 14' so that carabiner multi-tool 10' is essentially locked in the closed orientation as shown in FIG. 11.

Thus, carabiner multi-tool 10' can be conveniently carried by simply snapping it onto a belt or other piece of clothing in the same fashion as climbers carry carabiners. When positioned to encircle a belt or the like and locked in the closed orientation as shown in FIG. 11, carabiner multi-tool 10' cannot be lost or dropped and is convenient for use at any time. Also, it can be snapped onto a belt or other piece of clothing in a position that is out of the way so as not to interfere with whatever sport or other activity in which the user is engaged.

Another socket wrench 40' is formed in C-shaped portion 16' of body 12'. Another socket wrench 42' is formed in C-shaped portion 20' of body 12'. In this embodiment, socket wrenches 40' and 42' formed in the two C-shaped portions of the body are formed so as to be completely enclosed but they can be formed so as to open into the interior opening of body 12' or to open exterior to the central opening in body 12' if desired. In still another embodiment, similar to that illustrated in FIG. 8, the socket wrenches can be formed with axially extending sides to provide a better grip for the wrench. Also one of the wrenches can be completely enclosed and the other wrench opening inwardly or outwardly, if desired. Thus, it can be seen that virtually any size and shape of wrenches can be formed in the body of the carabiner multi-tool. Body 12' is designed to be more compact than body 12 if FIG. 1, to show the potential versatility of design that can be included.

Thus, a new and improved carabiner multi-tool has been disclosed that is convenient to use and that can be conveniently carried by snapping it onto a belt or other piece of clothing. Further, the new and improved carabiner multi-tool is relatively inexpensive to manufacture and to use. A large variety of tools can be included in a single carabiner multi-tool and a large variety of carabiner multi-tools can be manufactured for virtually every phase of a sport or work.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A carabiner multi-tool comprising:

a first generally C-shaped portion, a central extended portion, and a second generally C-shaped portion, the central extended portion joining a first end of the first C-shaped portion and a first end of the second C-shaped portion into a continuous body with a second end of the first C-shaped portion and a second end of the second C-shaped portion forming a first body end and a second body end positioned in spaced apart substantially opposed relationship;

a shaft having a fixed end pivotally attached to the first body end and a free end pivotally movable into a closed orientation with the second body end and an open orientation with the second body end;

an engagement member mounted on one of the free end of the shaft and the second body end for engaging the free end of the shaft and the second body end in the closed orientation so as to lock the shaft in the closed orientation, wherein the engagement member includes an axially extending socket wrench opening mounted on the free end of the shaft for limited axial movement therealong; and multiple tools formed in the first and the second generally C-shaped portions.

2. A carabiner multi-tool as claimed in claim 1 wherein the first generally C-shaped portion, the central extended portion, and the second generally C-shaped portion are formed as an integral unit.

3. A carabiner multi-tool as claimed in claim 1 wherein the multiple tools include a first socket wrench opening defined within the first generally C-shaped portion.

4. A carabiner multi-tool as claimed in claim 3 wherein the multiple tools include a second socket wrench opening defined within the second generally C-shaped portion.

5. A carabiner multi-tool as claimed in claim 4 wherein the first socket wrench opening and the second socket wrench opening define different sized socket wrenches.

6. A carabiner multi-tool as claimed in claim 4 wherein the multiple tools include a screw driver formed as a portion of one of the first generally C-shaped portion and the second generally C-shaped portion, the screw driver being formed so as to extend outwardly beyond the body.

7. A carabiner multi-tool as claimed in claim 4 wherein the first generally C-shaped portion, the central extended portion, and the second generally C-shaped portion define an inner open area therebetween and one of the first socket wrench opening and the second socket wrench opening include a side opening into the inner open area.

8. A carabiner multi-tool as claimed in claim 4 wherein the first generally C-shaped portion, the central extended portion, and the second generally C-shaped portion define an inner open area therebetween and one of the first socket wrench opening and the second socket wrench opening include a side opening external to the inner open area.

9. A carabiner multi-tool comprising:

a first generally C-shaped portion defining a first socket wrench opening therein;

a second generally C-shaped portion defining a second socket wrench opening therein;

a central extended portion joining a first end of the first C-shaped portion and a first end of the second C-shaped portion into a continuous body with a second end of the first C-shaped portion and a second end of the second C-shaped portion forming a first body end and a second body end positioned in spaced apart substantially opposed relationship;

a shaft having a fixed end pivotally attached to the first body end and a free end, the free end being pivotally movable into a closed orientation wherein the free end of the shaft is engaged with the second body end and an open orientation wherein the free end of the shaft is disengaged with the second body end; and an engagement member mounted on the free end of the shaft for engaging the second body end in the closed orientation and locking the shaft in the closed orientation, wherein the engagement member includes an axially extending socket wrench opening mounted on the free end of the shaft for limited axial movement therealong.

10. A carabiner multi-tool as claimed in claim 9 wherein the first generally C-shaped portion, the central extended portion, and the second generally C-shaped portion are formed as an integral unit.

11. A carabiner multi-tool as claimed in claim 9 wherein the first socket wrench opening and the second socket wrench opening define different sized socket wrenches.

12. A carabiner multi-tool as claimed in claim 9 wherein the body further includes a screw driver formed as a portion of one of the first generally C-shaped portion and the second generally C-shaped portion, the screw driver being formed so as to extend outwardly beyond the body.

13. A carabiner multi-tool as claimed in claim 9 wherein the first generally C-shaped portion, the central extended portion, and the second generally C-shaped portion define an inner open area therebetween and one of the first socket wrench opening and the second socket wrench opening include a side opening into the inner open area.

14. A carabiner multi-tool as claimed in claim 9 wherein the first generally C-shaped portion, the central extended portion, and the second generally C-shaped portion define an inner open area therebetween and one of the first socket wrench opening and the second socket wrench opening include a side opening external to the inner open area.

15. A carabiner multi-tool comprising:

a first generally C-shaped portion defining a first socket wrench opening therein;

a second generally C-shaped portion defining a second socket wrench opening therein;

a central extended portion joining a first end of the first C-shaped portion and a first end of the second C-shaped portion into a continuous body with a second end of the first C-shaped portion and a second end of the second C-shaped portion forming a first body end and a second body end positioned in spaced apart substantially opposed relationship;

an elongated shaft having a fixed end pivotally attached to the first body end and a free end, the free end being pivotally movable into a closed orientation and an open orientation; and an engagement member including an axially extending socket wrench opening mounted on the free end of the elongated shaft for limited axial movement therealong, the axially extending socket wrench opening being mounted on the free end of the shaft for engaging the second body end in the closed orientation and locking the shaft in the closed orientation.

16. A carabiner multi-tool as claimed in claim 15 wherein the first generally C-shaped portion, the central extended portion, and the second generally C-shaped portion are formed as an integral unit.

17. A carabiner multi-tool as claimed in claim 15 wherein the body further includes a screw driver formed as a portion of one of the first generally C-shaped portion and the second generally C-shaped portion, the screw driver being formed so as to extend outwardly beyond the body.

* * * * *